United States Patent [19]

Love

[11] 4,426,744

[45] Jan. 24, 1984

[54] COMBINATION OF AN OUTDOOR SWIMMING POOL AND ADJUSTABLE ROOF STRUCTURE

[76] Inventor: William Love, Silverstone, Uffmor La., Halesowen, Midlands, England

[21] Appl. No.: 9,833

[22] Filed: Feb. 2, 1979

[51] Int. Cl.[3] ..... E04H 3/19

[52] U.S. Cl. ..... 4/503; 4/488; 4/500

[58] Field of Search ..... 4/172, 172.11, 172.12, 4/172.13, 172.14, 149, 153, 154, 116, 146, 460, 488, 494, 496, 498, 500, 503, 504, 557, 558, 580, 596, 597, 607, 608, 610; 135/1 R, 1 A, 5 B; 52/63, 66, 169.7; 160/349 R

[56] References Cited

U.S. PATENT DOCUMENTS

| | | | |
|---|---|---|---|
| 2,229,908 | 1/1941 | Wenneborg | 4/172 |
| 2,761,150 | 9/1956 | Kellogg | 160/349 R |
| 2,912,703 | 11/1959 | Murphy | 4/172.11 |
| 2,961,255 | 11/1960 | Trott | 52/63 X |
| 3,009,166 | 11/1961 | Sears | 4/172.11 |
| 3,093,834 | 6/1963 | Watkins | 4/172.11 |
| 3,241,157 | 3/1966 | Baker et al. | 4/172.11 |
| 3,415,260 | 12/1968 | Hall | 4/172.12 X |
| 3,552,072 | 1/1971 | O'Connell | 4/172.14 X |
| 3,566,420 | 3/1971 | Peterson et al. | 4/172.11 |
| 3,777,319 | 12/1973 | Myles | 4/172.14 |

*Primary Examiner*—Stephen Marcus
*Assistant Examiner*—Kenneth S. Putnam
*Attorney, Agent, or Firm*—Cushman, Darby & Cushman

[57] ABSTRACT

This invention relates to the combination of an outdoor swimming pool and adjustable roof structure mounted so as to extend over the pool and a patio adjacent to the pool. When the roof structure is in a raised position, the pool may be used by bathers, positionally adjustable curtaining extending between the roof structure and a ground area surrounding the pool and patio providing protection against adverse weather conditions. When the roof structure is in a lowered position, it prevents access to the pool, providing a safeguard against small children falling into the pool when it is not being used by adults. Additionally, when the roof structure is in its lowered position, insulating members carried thereby lie directly over the pool, minimizing heat loss therefrom. Desirably, the roof structure or part thereof may be moved to open the pool to the sunshine, while providing shade and protection against wind to non-bathers sojourning on the adjacent patio.

1 Claim, 3 Drawing Figures

COMBINATION OF AN OUTDOOR SWIMMING POOL AND ADJUSTABLE ROOF STRUCTURE

BACKGROUND OF THE INVENTION

It is known to provide an outdoor swimming pool, particularly a swimming pool intended for private use, with covering members which may be moved manually into positions across the pool, to cover the pool when it is no longer intended to use the pool. Such coverings members were primarily intended to prevent children from accidentally falling into the pool when the pool was not being used by adults, and was additionally effective to prevent detritus from blowing into the pool. However, conventionally such covering members have been seated on, extending between, peripheral margins bounding the pool, and have been of rigid construction. Because of the difficulty of moving the covering members into position, they were not generally used when the pool was vacated for short periods of time (e.g. overnight) and were used only when it was intended not to use the pool for an extended period of time (e.g. over the winter period). This meant that there was a considerable residual danger of children falling into the pool during the short periods when adults were not using the pool.

To increase the ease with which a pool could be covered, and hence to reduce this possible residual danger, a suggestion has been made to provide a covering structure which could be moved automatically between a raised position in which access to the pool and consequent use thereof was permitted, and a lowered position in which access to the pool by (for example) small children was prevented. Thus, this relatively simple means of closing the pool tended to ensure that the pool was closed when it was being vacated by adults for relatively short periods of time (e.g. overnight).

However, such previous suggestions have involved merely a covering structure which when in its lowered position seated on and extended between peripheral margins bounding the pool: other than providing protection to bathers using the pool against directly overhead sunshine, or wholly vertically-falling rain, there has been no previous suggestion to use the idea of a power operated pool covering to provide protection to persons swimming in the pool, and persons sojourning on a patio adjacent to the pool, against adverse weather conditions.

SUMMARY OF THE INVENTION

According to this invention there is provided an outdoor swimming pool having a roof structure extending over the pool and over a patio adjacent to the pool, the roof structure being mounted for vertical movement by power-operated means between a lowered position, in which it prevents access to the pool, and a raised position in which access to the pool is permitted, securing means being provided along a line extending around the periphery of the pool and adjacent patio, with curtains extending from the roof structure to said securing means which curtains may be drawn around a selected side or sides of the pool and adjacent patio.

Thus, the curtains may be drawn to provide shelter against prevailing wind and/or rain, allowing the pool to be used more comfortably in unfavourable weather conditions.

Further, by drawing the curtains entirely to enclose the pool and adjacent patio, the area surrounding the pool, including the patio, may be heated, permitting the pool to be used in comfort even though the atmospheric temperature outside the pool be exceedingly low.

Preferably the roof structure is gabled: in this manner pool-side furniture standing on the patio may be left standing thereon whilst the roof structure is moved to its lowered position.

An additional disadvantage not solved by the prior art suggestions is the loss in heat from the water in the pool during the night-time. In particular, the prior art suggestions to provide a vertically movable cover have specified the need for a rigid construction, which necessarily requires the roof structure to be of metal. When such a roof structure is in its lowered position, heat loss from the pool is reduced only by a minor extent. The maintenance of a desired water temperature is one of the major items in the cost of using a swimming pool, particularly in the more northerly latitudes, and, using the conventional, vertically movable cover, the amount of energy required to maintain the water temperature during cold weather is such as to deter persons from maintaining the pool water temperature at a comfortable level, to enable the pool to be used (for example) during the spring and fall.

Thus, in accordance with this invention, preferably the roof structure supports insulating members which, when the roof structure is in its lowered position, are seated on and extend between the peripheral margins bounding the pool.

Since such insulating members are not required to bear load, and desirably since they are supported by the roof structure, the insulating members may be a lightweight materials having excellent heat insulation properties.

Desirably, to improve the available headroom with the roof structure in its raised position, said insulating members are so mounted on the roof structure as to be capable of vertical movement relative thereto. For example, the insulating members may be supported by cables or the like extending around pulleys secured to the interior of the roof structure, a pulley system being provided with operates, as the roof structure moves towards its lowered position, to cause relative lowering movement of the insulating members relative to the roof structure, to ensure that, at the time when the roof structure reaches its lowered position, the roof structures seat against the peripheral margin bounding the pool.

Most conveniently, the power operated means comprises fluid operated piston/cylinder devices, supply means to supply fluid under pressure to said devices, and control mechanism for controlling the devices, advantageously simultaneously. Conveniently four or more such devices are provided, spaced around the pool and adjacent patio, being operative to support the roof structure.

Further, although in prior proposals the roof structure has provided shade from the sunlight falling onto the pool, more often it is not desired to so shade the pool and bathers using the pool. Thus, desirably the roof structure comprises at least one roof section which, when the roof structures is in its raised position, may be moved laterally so as to open the pool to sunshine. Desirably such movement of said roof section is effective to increase the area of the adjacent patio, which is protected by the roof structure.

Thus, conveniently the roof structure comprises a framework secured to upper portions of the piston/cylinder devices, and roof sections carried by the framework. Thus, at least one of the roof sections may comprise rollers which engage in a trackway provided by the framework, enabling said roof section to be moved laterally as aforesaid. Preferably however, the control means is operative to prevent a lowering movement of the piston/cylinder devices when the said roof section is in its laterally removed position.

Preferably the roof structure comprises a downwardly-extending skirt which when the roof structure is in its lowered position will extend around the outside of a raised wall bounding the pool and adjacent patio area. This enables the roof structure to more effectively enclose the pool, to prevent entrance thereto of detritus, more effectively and/or with greater tolerances of manufacture, than would be the case were such a raised wall not provided.

Conveniently the securing means is provided by a curtain rail secured to an inner side of the wall. In this manner, when the roof structure is moved to its lowered position, the curtain may collapse into the interior space, as the skirt of the roof structure moves towards the peripheral wall.

DETAILED DESCRIPTION OF THE PREFERRED EMBODIMENT

Figure 1:
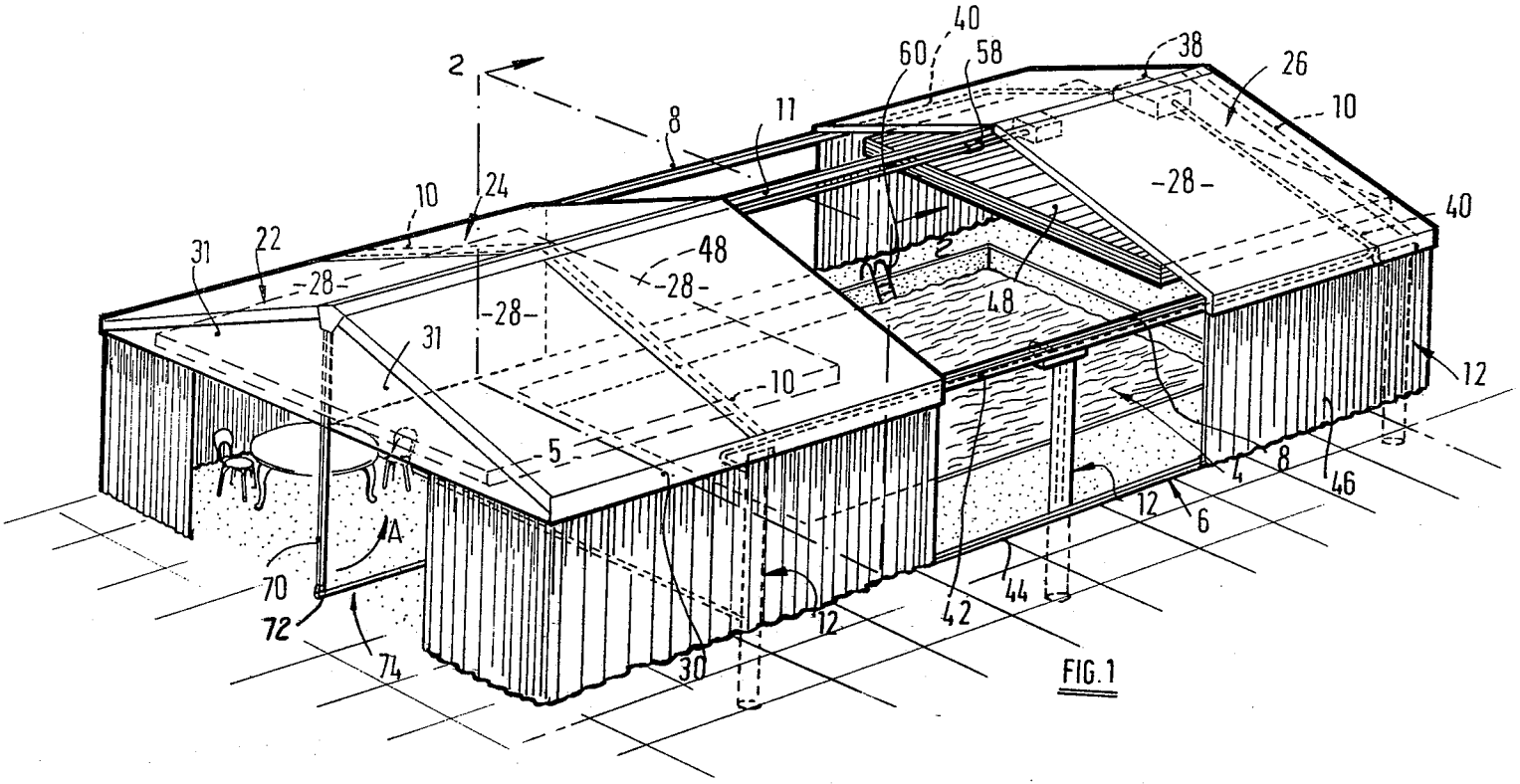
FIG. 1 is a perspective view of a roof structure which is a preferred embodiment of this invention, illustrating one of the roof sections thereof in a retracted position.

The roof structure 2 shown in the drawings is mounted above a swimming pool 4 and an adjacent patio area 5, said pool 4 and area 5 being bounded along its two longitudinal sides by a shallow peripheral wall 6. The roof structure comprises a frame work comprising a pair of parallel rails 8, each being secured to the upper ends of fluid operated piston/cylinder devices 12, of which there are six. Each piston cylinder device 12 comprises a sleeve 14 which is sunk into the ground, and a piston rod 16 extending centrally therethrough, the upper end of the rods 16 carrying a piston 18. Slidable over the piston 18 is a cylinder 20, the struts 10 each being secured to and extending between the tops of three of said cylinders. Extending upwardly and inwardly from the rails 8 are a number of sloping struts 10, which support a horizontal rail 11.

The roof support comprises three roof sections 22, 24 and 26, each comprising a girder support (not shown) supporting gabled roof panels 28 and an outer skirt 30. The roof sections 22 and 26 are additionally provided with end skirts 31.

The roof sections 22 and 24 each comprise two pairs of inwardly-extending axles 32, each axle carrying a roller 34 which is received in a trackway 36 provided by one or other of the two rails 8. The roof section 26 is however fixed to the rails 8. The roof structure 22 also comprises a vertical strut 70 which carries at its lower end a roller 72, which seats in a trackway 74 provided in the patio area adjacent to the area 5.

The section 26 supports a control assembly 38 comprising an electrically-driven air pump, conduits 40 extending via valve mechanism outwardly of the control assembly, and lengthwise alongside the rails 8. Branch conduits 41 connect one or other of the conduits 40 with the cylinders 20 of each of the piston/cylinder devices 12.

By manual manipulation of control switches of the assembly 38, air under pressure may be delivered via the conduits 40 and branch conduits 41 simultaneously to the six cylinders 20, causing the cylinders to be moved upwardly (FIG. 2) and the roof structure into a raised position. Conversely, by operating another control switch of the assembly 38, said cylinders may be vented to atmosphere, allowing the cylinders to fall under the combined weight of the cylinders and roof structure, so that the roof structure adopts a lowered position (shown in dotted lines in FIG. 2).

Mounted on the inner side of the skirts 30 and 31 is a continuous upper curtain rail 42, and secured to the peripheral wall 6 on an outer side thereof is a continuous lower curtain rail 44. Extending between the curtain rails 42 and 44, so as to be capable of being drawn entirely around the swimming pool 4 and adjacent patio area 5, are curtains 46.

The roof structure also comprises two insulating panels 48, one being associated with each of the roof sections 24 and 26. Each insulating panel is supported by cables 50 extending around a pulley system 52, secured on the interior of the roof section at its highest point, namely the horizontal rail 11. The insulating panels 48 are of wire-reinforced foam plastics materials, such as polyurethane, and drapes 56 are hung from the side margins of the panels 48 to the roof panels, to provide an ethetically pleasing finish.

Secured to the horizontal rail 11 is an elongate cylinder 58, having slidably mounted therein a piston rod which is secured to the roof sections 22 and 24. By manual manipulation of a third contact switch, air under pressure may be delivered from the control assembly 38 to the cylinder 58, causing the piston rod thereof to outstroke.

FIG. 1 illustrates the roof structure in an open-most position, as would be suitable for use on a warm summers day. Air under pressure has been admitted to the cylinder 58, causing the piston rod thereof to out stroke, carrying the roof section 22 and 24 away from the roof section 26 to open part of the pool 4 to the sunshine, whilst extending the patio area 5 to which protection is afforded by the roof structure. In this position, the roof section 24 is supported by means of the location of its four wheels 34 in the trackway 36, whilst the roof section 22 is supported by location of two of its wheels 34 in the trackway 36, and by the vertical strut 70. The curtains are shown, having been drawn to provide selected shelter against prevailing winds, and to provide for a desired degree of privacy. The curtains which are appendant to the roof sections 24 and 26 extend between the upper curtain rail 42 and the lower curtain rail 44, whilst the curtains appendant to the roof section 22 are not supported at their lower most ends.

By manual manipulation of the third control switch, reverse air pressure may be applied to the cylinder 58 to cause the piston rod thereof to instroke, drawing the roof sections 22 and 24 inwardly towards the roof section 26. The curtains appendant to the roof section 22 may then be attached to that part of the curtain rail extending around the patio area 5. In this position of the roof structure, the curtains may be drawn entirely to enclose the pool and adjacent patio, and in this (intermediate) position, by the use of portable heating means, the atmospheric temperature in the vicinity of the pool 4 and the patio 5 may be increased to a desirable temperature. Thus, in this position of the roof structure, it may be used comfortably on a cold winters day.

Figure 2:
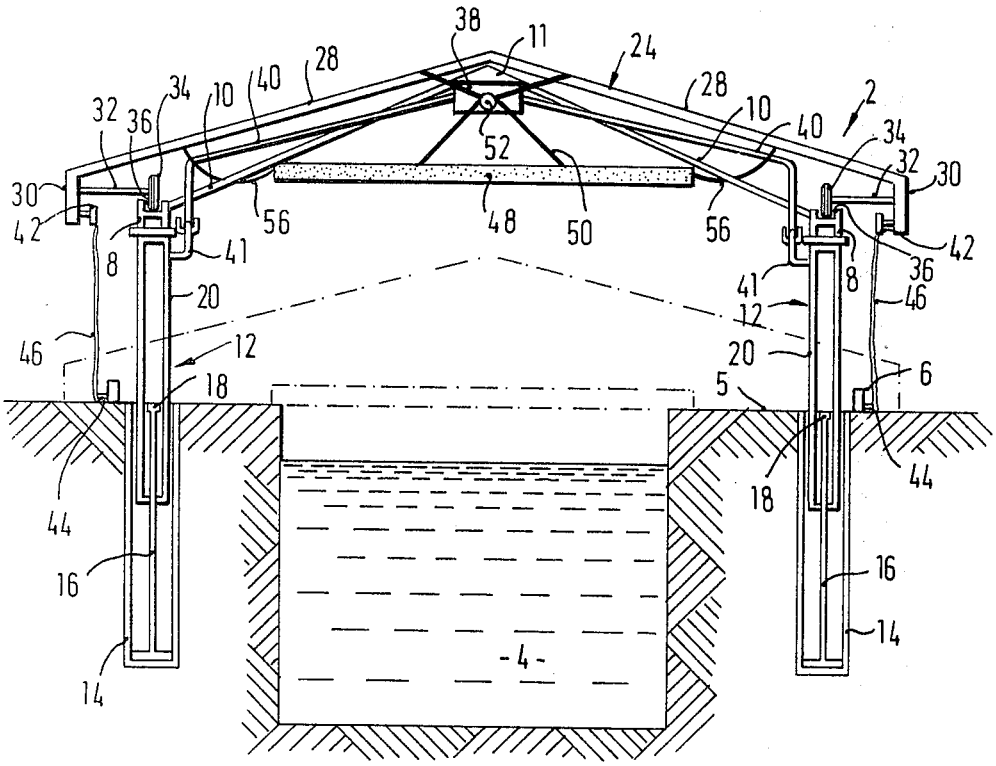
FIG. 2 is a vertical sectional view of the preferred embodiment.
Figure 3:
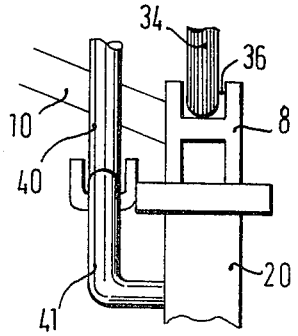
FIG. 3 is an enlarged view of part of FIG. 2.

When it is desired to use the pool no further, by manual manipulation of the second control switch of the assembly 38, the cylinders 20 may be vented to the atmosphere, allowing the roof sections to fall towards the positions shown in dotted lines in FIG. 2. Prior to this operation, it will in the preferred embodiment, be necessary to swing the strut in the direction of the arrow A (FIG. 1) into an out-of-the-way position. It will however be appreciated that alternative means of supporting the roof section 22 may be used, such as a fixed exterior gantry. Further it is desirable to remove any excrescence surrounding the pool, such as the handrail 60 shown in FIG. 1, together with any diving boards which may be used, and it is desirable to move the pool side furniture illustrated in FIG. 1 to the patio area 5. As the roof structure lowers, care will be taken to ensure that the curtains 46 are retained inwardly of the peripheral wall 6, so that they do not become trapped as the skirts 30 and 31 move into the ground engaging positions.

As the roof structure as a whole is lowered, the control assembly 38 is also desirably operative to increase the lengths of the cables 50, by which the insulating panels 48 are suspended, to allow downward relative movement of the insulating panels relative to the roof sections, as the roof sections are themselves lowered. Thus, as the roof sections moved to their fully lowered positions, the insulating panels adopt positions in which they seat on, and extend across, peripheral margins bounding the pool, as is illustrated in dotted lines in FIG. 2.

Desirably the combined swimming pool/roof structure which is the preferred embodiment of this invention comprises safety devices, conveniently afforded by micro-switches, which ensure that the roof structure cannot be moved to its lowered position, unless the roof sections 22 and 24 are in their intermediate, closed positions.

By the use of this invention, the following advantages may be gained:

(a) The pool may be used conveniently during periods of heavy rain without inconvenience, with the roof structure in its intermediate position, the protection afforded to the adjacent patio area 5 by the roof structure being of considerable importance in this respect. The curtains may be drawn to provide maximum protection against wind and rain, and the capability of fully enclosing the pool 4 and patio area 5 permits the effective use of portable heating means. It has been found practicable, using the invention in this mode, to swim comfortably even during the fall of heavy snow.

The provision of the curtains 46 additionally prevents diagonally-falling rail from entering the pool, which would tend to lower the temperature of the pool water, and additionally tend to dilute purifying agents present in the pool water.

Even with the roof structure in its intermediate position, a protected pathway is provided entirely around the pool, enabling the pool to be used conveniently even whilst protection against environmental conditions is provided.

(b) However, should the rain against which protection is being sought by merely temporary, upon its cessation the curtains may be drawn to provide an opening of the pool and patio area 5 to external conditions.

(c) With the roof structure in its fully open position, as illustrated in FIG. 1, the curtains may be drawn to provide no effective obstruction to pleasurable envorimental conditions, and sunshine is allowed to fall onto the the greater part of the pool 4, permitting bathers to obtain full enjoyment. However, shade is provided over the patio area 5 and the area adjacent thereto, permitting non-bathers to sojourn in shaded conditions.

(d) The convenience with which the roof structure may be moved from its fully open position back to its intermediate positions, and subsequently moved to its lowered position, encourages the closing of the pool when the pool is to be vacated by adults even for short periods. Thus, the advantage of preventing access to the pool by small children is retained, notwithstanding the considerable advantages afforded by the invention.

(e) With the roof structure in its lowered position, the insulating members are effective almost entirely to eliminate heat losses from the water in the pool. Thus, the pool may be left unused for a considerable period of time during cold weather conditions, without significant fall in the temperature of the pool water. This reduces the cost of raising the pool water temperature to a desired temperature, encouraging use of the pool during the winter time.

I claim:

1. An outdoor swimming pool having a roof structure extending over the pool and over a patio laterally adjacent to the pool, the roof structure being mounted for vertical movement by power operated means between a lowered position, in which it prevents access to the pool, and a raised position in which access to the pool is permitted, securing means being provided along a line extending around the periphery of the pool and adjacent patio, with curtains extending from the roof structure to said securing means, which curtains may be drawn around a selected side or sides of the pool and adjacent patio;

a plurality of thermal insulating members;

the roof structure supporting said insulating members which, when the roof structure is in its lowered position are seated on and extend between the peripheral margins bounding the pool;

the insulating members being so mounted on the roof structure that on movement of the roof structure to its lowered position, lowering movement of the insulating members takes place relative to the roof structure itself;

a portion of said roof structure being separate from the thus-defined remainder of said roof structure; said roof structure portion having at least one of said curtains and at least one of said insulating members associated therewith;

said roof structure portion being mounted for lateral movement together with said at least one curtain and said at least one insulating member associated therewith when in said raised position.

* * * * *